United States Patent [19]

Thomas

[11] 4,413,481

[45] Nov. 8, 1983

[54] PORTABLE BEVERAGE COOLER

[76] Inventor: William S. Thomas, 160-19 Normal Rd., Jamaica, N.Y. 11432

[21] Appl. No.: 399,300

[22] Filed: Jul. 19, 1982

[51] Int. Cl.[3] ..... F25D 3/08

[52] U.S. Cl. ..... 62/371; 62/372; 62/457; 62/530; 150/52 R; 220/449

[58] Field of Search ..... 62/371, 372, 457, 530; 220/449; 150/52 R

[56] References Cited

U.S. PATENT DOCUMENTS

| | | | |
|---|---|---|---|
| 2,602,302 | 7/1952 | Poux | 62/530 |
| 2,652,698 | 9/1953 | Schlumbohm | 62/371 X |
| 4,197,890 | 4/1980 | Simko | 62/372 X |
| 4,211,091 | 7/1980 | Campbell | 62/372 |
| 4,324,111 | 4/1982 | Edwards | 62/530 X |
| 4,344,303 | 8/1982 | Kelly, Jr. | 62/530 |

FOREIGN PATENT DOCUMENTS

| | | | |
|---|---|---|---|
| 1254986 | 1/1961 | France | 62/530 |

*Primary Examiner*—Lloyd L. King
*Attorney, Agent, or Firm*—Charles E. Temko

[57] ABSTRACT

A wrap-around type portable beverage cooler suitable for cooling and maintaining in cooled condition a small container such as an individual wine bottle, soft drink bottle, or sealed cane. The device includes an elastic belt, a portion of which is disposed between the individual walls of a flexible coolant-retaining jacket, the ends of the belt being selectively interconnectable to retain the jacket in surrounding relation relative to the container. An integral strap carried by the lower periphery of the jacket passes under the container to prevent slipping of the container relative to the jacket. Elongate cords pass through openings adjacent the upper periphery of the jacket to enable the jacket and container to be carried without chilling the fingers of a user.

3 Claims, 4 Drawing Figures

PORTABLE BEVERAGE COOLER

BACKGROUND OF THE INVENTION

This invention relates generally to the field of portable beverage coolers, and more particularly to an improved type adapted for the cooling of a single sealed container, such as a metallic can or small glass or synthetic resinuous bottle.

It is known in the art to use sealed devices containing liquified chemical compositions having very high specific heats to provide a cooling effect similar to that of melting ice. Such structures have been incorporated in sealed form within rigid jackets to surround wine bottles, for example. It is also known to use such materials within rigid portable cold chests of a type most conveniently molded from polystyrene foam. Other devices known in the art include flexible type jackets adapted to be wrapped about a beverage container using tie strings or Velcro closures.

It is often desirable to manually carry a single or small number or individual bottles or cans of soft drink, beer, or other beverage in cooled condition without the use of a larger container, as for example, during an outdoor walk, or while jogging or riding a bicycle. When the container is maintained in suitably cold condition, it is not comfortable to continuously grasp the container for the reason that the hand becomes chilled. The transfer of heat from the hand to the container also deleteriously affects the cooling effect of the jacket.

SUMMARY OF THE INVENTION

Briefly stated, the invention contemplates the provision in a device of the class described of an improved means for mounting the refrigerant-containing jacket upon the container, and for comfortably carrying the same. To this end, the device includes a flexible planar synthetic resinous jacket having sealed pockets for the retention of a coolant in either solid or liquid state. A hollow longitudinally extending pocket is provided between the walls of the jacket for accommodating an elastic strap or band having mutually interconnecting means at the opposite ends thereof which, when interconnected, resiliently contract the jacket upon an enclosed beverage container. The jacket includes a second strap secured at either end to a lower periphery of the jacket, which, in engaged condition, positions the strap under the bottom wall of an enclosed container to prevent relative slipping. At the upper periphery of the jacket are a series of grommets engaged by elongated cords which provide an insulated means for manual engagement of the device and enclosed bottle or container in pendant relation.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
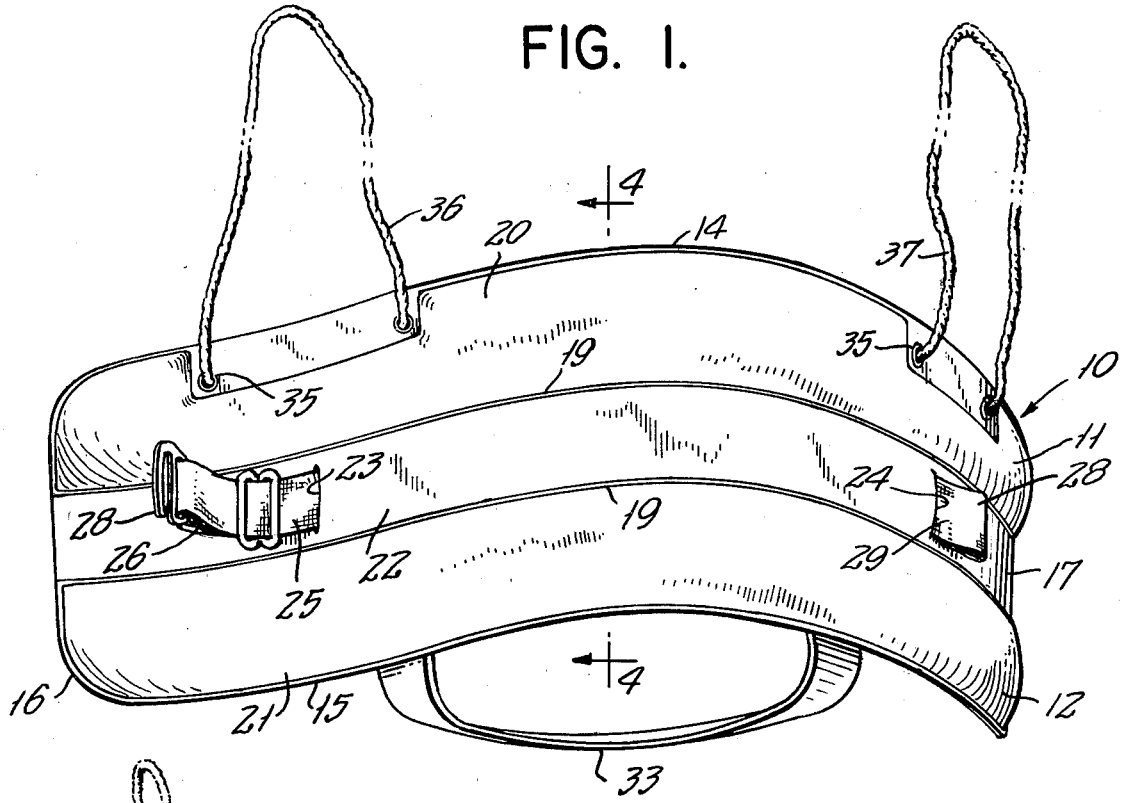
FIG. 1 is a view in perspective of an embodiment of the invention.
Figure 2:
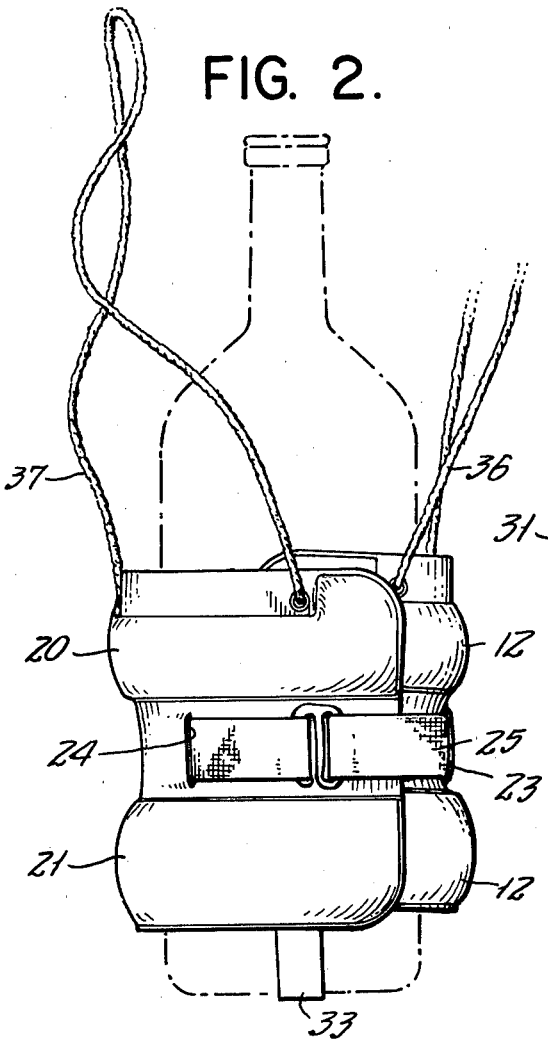
FIG. 2 is a side elevational view of the embodiment in engaged condition upon a beverage container.
Figure 3:
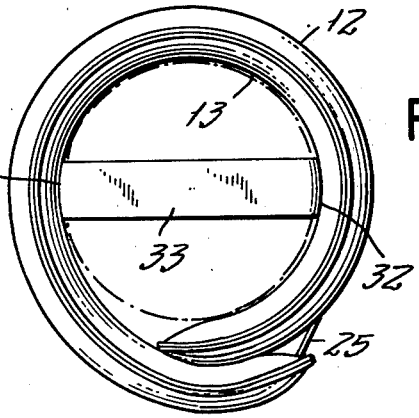
FIG. 3 is a bottom plan view thereof as seen from the lower portion of FIG. 2.
Figure 4:
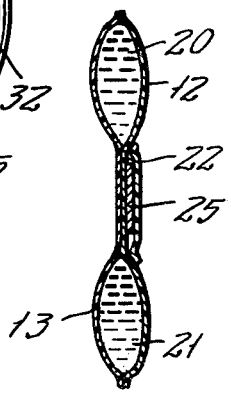
FIG. 4 is a sectional view as seen from the plane 4—4 in FIG. 1.

In accordance with the invention, the device, generally indicated by reference character 10, comprises a main body element 11 of laminated synthetic resinous material, including a first or outer wall 12 and a second or inner wall 13. The element is bounded along the periphery thereof by an upper edge 14, a lower edge 15, and end edges 16 and 17. Parallel to the upper and lower edges are a pair of longitudinally extending sealed areas 19 defining an upper compartment or pocket 20, a lower compartment or pocket 21, and a belt retaining channel or pocket 22. First and second transversely extending slots 23 and 24 penetrate the outer wall 12 to provide ingress to the pocket 22 which slidably retains an elongated elastic belt 25 having first and second ends 26 and 27 with mutually interconnecting means 28 thereat.

Disposed on the inner surface 30 of the inner wall 13 are the heat sealed terminals 31 and 32 of an elongated plastic strip 33, the terminals 31 and 32 being so spaced that when the main body element 11 is engaged upon a container 34 the strap 33 will be diagonally disposed with respect to a lower wall thereof.

Disposed along the upper edge 14 are a plurality of grommets 35 which penetrate the upper pocket 20 in sealed relation. These are engaged by first and second cords 36 and 37 of suitable length to enable the jacket and enclosed container to be conveniently manually carried without the necessity of the hands of the user contacting the container.

It will be observed that the beverage container can be opened without the necessity of removing the cooler, thereby permitting, in the case of a resealable container for the contents to be consumed over a period of time.

I wish it to be understood that I do not consider the invention limited to the precise details of structure shown and set forth in this specification, for obvious modifications will occur to those skilled in the art to which the invention pertains.

I claim:

1. An improved portable beverage cooler comprising: a flexible planar main body element including inner and outer walls of generally rectangular configuration, said walls being interconnected at the peripheral upper, lower, and end edges thereof, and along a pair of parallel longitudinally extending areas to define upper and lower pockets for the sealed retention of a cooling medium, and a medially disposed pocket, said medially disposed pocket having transversely extending slotted openings in said outer wall leading thereto disposed medially of said end edges of said main body element; an elongated elastic member slidably disposed within said medially disposed pocket, and having first and second ends provided with mutually interconnecting means; and an elongated strap member having first and second ends interconnected to said main body element adjacent said lower edge thereof; whereby when said main body element is wrapped about a beverage container of predetermined diameter, said last mentioned strap is positioned beneath a lower wall of said container to prevent relative slipping between said main body element and said container.

2. A cooler in accordance with claim 1, further characterized in the provision of insulative manually engageable carrying means engaged with said main body element at said upper edge thereof.

3. A cooler in accordance with claim 2, in which said last mentioned carrying means includes a plurality of grommets passing through main body element, and at least one elongated cord passing through said grommets.

* * * * *